United States Patent [19]

Tate

[11] Patent Number: 4,725,999

[45] Date of Patent: Feb. 16, 1988

[54] TIMER SYSTEM FOR MEDICINE TAKING

[76] Inventor: Raymond E. Tate, 829 Oakdale Cir., Millersville, Md. 21108

[21] Appl. No.: 65,351

[22] Filed: Jun. 23, 1987

[51] Int. Cl.[4] ..... G04B 47/00

[52] U.S. Cl. ..... 368/10; 368/107

[58] Field of Search ..... 368/10, 107–109, 368/390.1, 276, 89, 73, 113, 72–74; 221/2, 3; 340/309.1, 309.4

[56] References Cited

U.S. PATENT DOCUMENTS

| | | | |
|---|---|---|---|
| 2,853,182 | 9/1958 | Barnett | 368/10 |
| 3,762,601 | 10/1973 | McLaughlin | 221/2 |
| 3,818,473 | 6/1974 | Murray et al. | 340/309.4 |
| 4,074,251 | 2/1978 | Creely | 340/309.4 |
| 4,275,384 | 6/1981 | Hicks et al. | 340/309.1 |
| 4,483,626 | 11/1984 | Noble | 368/10 |
| 4,490,711 | 12/1984 | Johnston | 368/10 |
| 4,626,105 | 12/1986 | Miller | 368/10 |

*Primary Examiner*—Bernard Roskoski
*Attorney, Agent, or Firm*—John F. McClellan, Sr.

[57] ABSTRACT

A medicine timer provides a frame mounting a series of compartments in a row for holding medicine such as different kinds of pills, either in containers or not. Associatable with each compartment is a respective timer head, by means of detachable electrical plug-in connections in the frame adjacent each compartment. Each timer head, of which five or more can be provided, is adjustable by means of a rotary pointer and hour marks to which pointed to signal at desired times such as, for example, every two hours. A range of selectable times for each timer head of at least up to twenty-four hours is desirable although each timer head may be different. Signal is preferably by sound for a general alert, and by light, each timer head also having a light on it for specific alert, day or night, as well as a reset and an on-off switch button. Battery power is in the frame and preferably the sounding device is also in the frame.

8 Claims, 7 Drawing Figures

TIMER SYSTEM FOR MEDICINE TAKING

FIELD OF THE INVENTION

This invention relates generally to timing devices and particularly to systems used to signal when one or more medications are to be taken.

BACKGROUND OF THE INVENTION

Among patents pertinent to the field of the invention are:

U.S. Pat. No. 3,818,473 issued to M. R. and D. A. Murray on 6-18-74, showed a form of timer used as a pill reminder with a container and signalling means; evidently as many of these could be used at a time as desired, for various medicines and time periods.

U.S. Pat. No. 4,074,251 issued to W. E. Creely on 2-14-78 provided a one-unit clock with a multiple-compartment container.

SUMMARY OF THE INVENTION

None of the known art is believed to provide, according to the objects of this invention the combination of simplicity of setting individual medication alarm periods with the versatility of providing for reminders to take a plurality of medications alone or mixed with others.

Further objects are to provide a system that keeps the medication itself visible as a guide at all times so that those having impairments of sight or memory will, in most cases, be able to dose themselves with a minimum of confusion or need for help from others, because of the graphical nature of the layout provided by this invention.

Still further objects are to provide a system as described in which only as many of the timing heads need to be bought (or rented) as will be required for the numbers of different medicines taken at separate times, and in which a large combination of medicines and dosages and times can be taken care of in signalling to the user or nurse or other party interested. Any yet further objects are to provide a system as described that is easy to set to signal when and what medicines to take, that is reliable, and that is attractive in appearance and easy to check for proper setting, easy to operate, and economical to make, use and sell.

And other objects are to provide a system as desribed that is lightweight and portable, and that has interchangeable timing heads, and offers both acoustical and light signalling on lapse of time preset into it.

The timer is a system designed to simplify the administration of medication prescribed to be taken at predeterminable intervals. A base unit includes a battery pack and an alarm speaker, with provision for up to four (4) timer units. Each timer unit plugs into the base unit, which both supplies power and sounds alarm through a simple conventional two-pronged connector in a conventional representative circuit, not claimed to be part of the invention, but that is designed to perform the overall functions specified by the invention. Each of the timer-dispenser units has storage space for one pill bottle of any normal size, a time select switch for 2, 4, 6, 8, 10 and 12 hours, an alarm lamp, and a reset switch. To operate a timer/dispenser unit, the user simply plugs it into the base, sets the time-select switch as required for the medication, and presses the reset switch. After the specified time period, the alarm will sound, and the lamp on the dispenser will glow, indicating which medication should be taken. When the reset switch is again pressed, the alarm stops and the next timing interval begins.

Said another way, in a preferred embodiment the invention includes a medicine timer that provides a base or frame mounting a series of compartments in a row for holding medicine such as different kinds of pills, either in containers or not. Associatable with each compartment is a respective timer unit or timer head, by means of detachable electrical plug-in connection in the frame adjacent each compartment. Each timer head (of which at least five can be easily provided) is adjustable by means of a rotary pointer and hour marks to which the pointer is set to signal at desired times such as, for example, every two hours. A range of selectable times for each timer head of at least up to twenty four hours is desirable, although each timer head may be different. Signal is preferably by sound for a general alert and by light, each timer head also having a light on it for specific alert, day or night, as well as a reset button. Also provided is an on-off switch button controlling power for the system. Battery power is located in the base or frame and preferably the sounding device is also in the frame.

DETAILED DESCRIPTION

Figure 1:
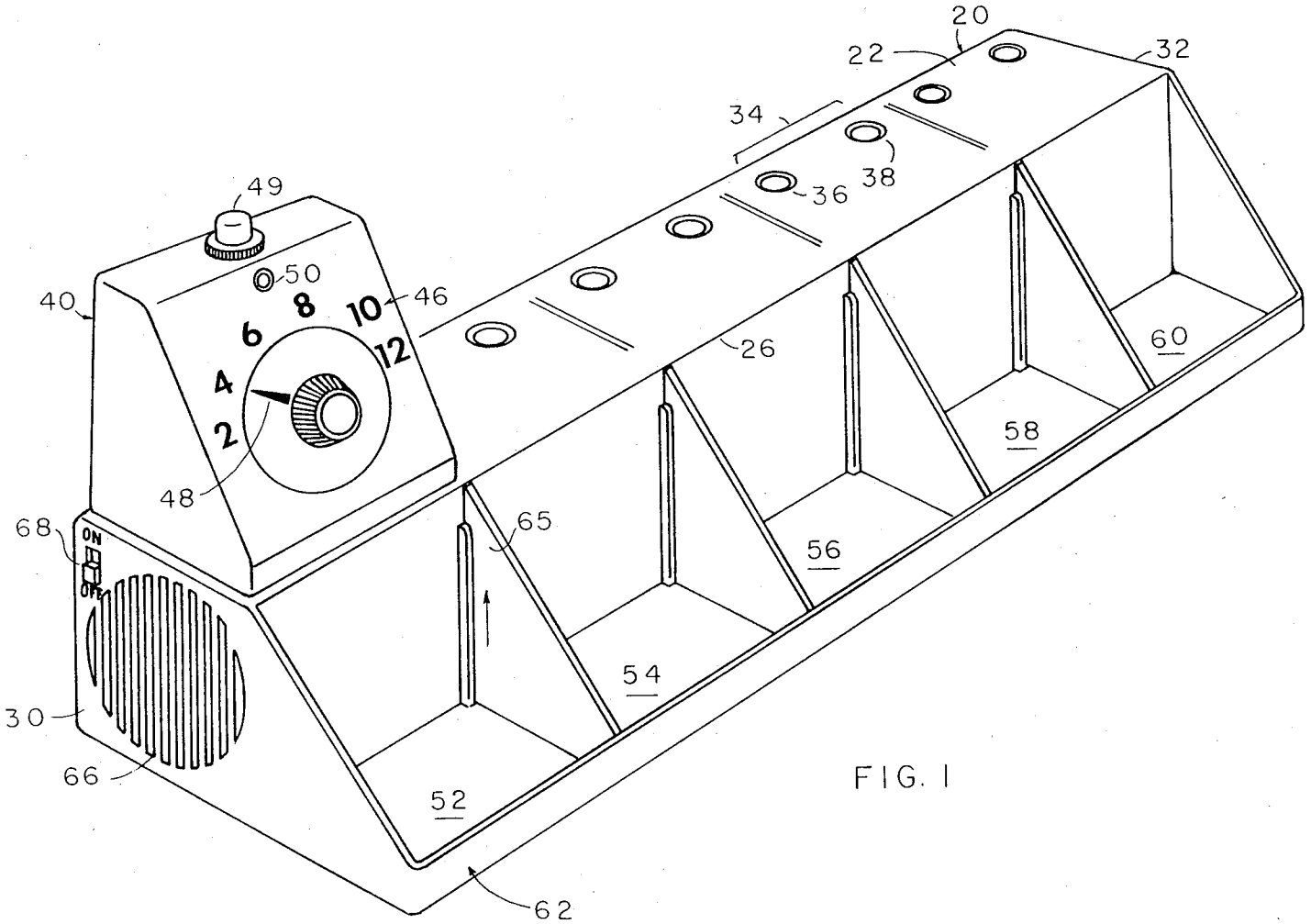
FIG. 1 is a top perspective view of an assembly according to this invention.
Figure 2:
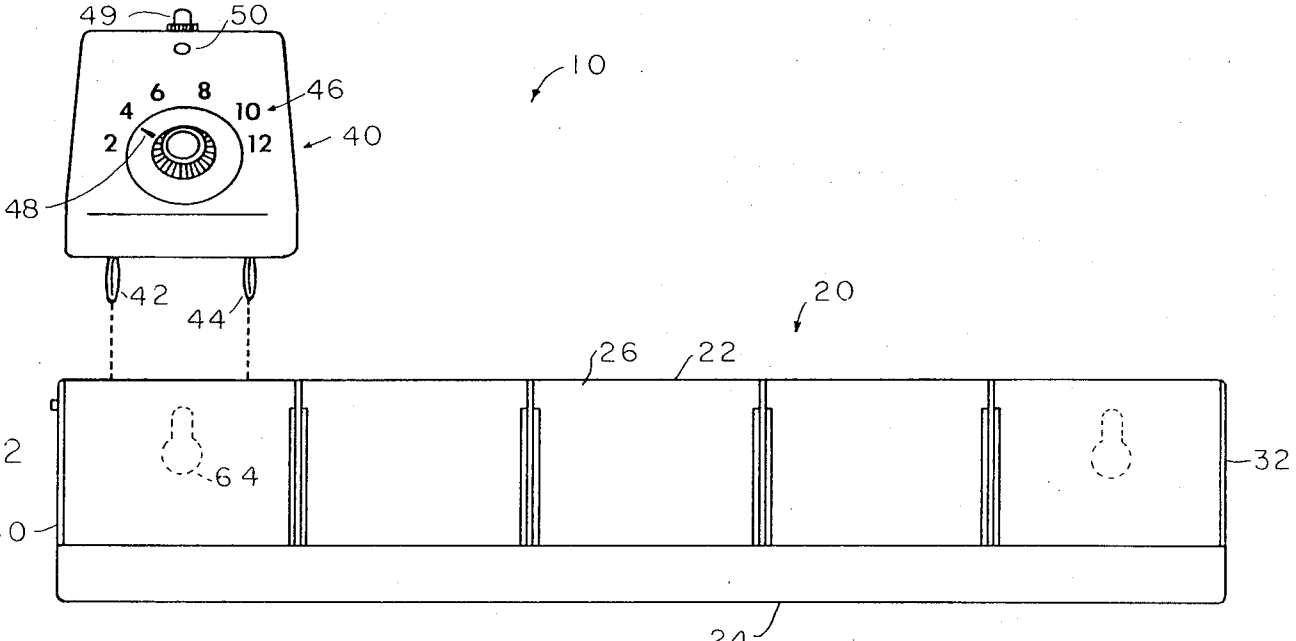
FIG. 2 is a front elevational partially exploded view thereof to show relation of a timer head.
Figure 3:
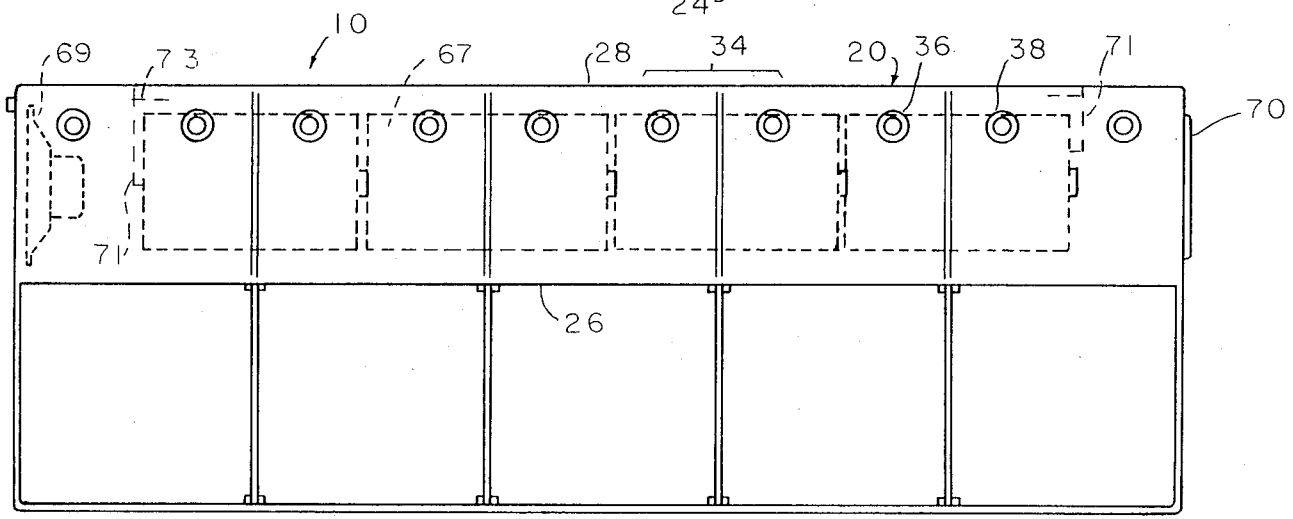
FIG. 3 is a plan view with portions detached.

FIGS. 1–3 show the preferred embodiment 10 of the invention in a top perspective view. Housing or frame 20 has a longitudinal, preferably square-section shape with a substantially horizontal top 22 and bottom 24 and upright first and second sides, 26, 28 and ends 30, 32.

Along the top 22 at regularly spaced intervals may be identical pairs 34 of electrical connectors 36, 38, preferably sockets, polarized by size, if desired, that define timer head locations.

Each pair 34 of sockets can receive a respective timer head 40 which has a pair 42, 44 of corresponding male connectors that fit into any pair of the sockets. When connected to the frame 20, each timer head faces toward the first side 26 of the frame, so that the time insignia 46 and pointer 48 and light signal 50 can all be seen from the frame first side 26. A conventional reset button 49 resets the timing to zero and starts the cycle again, when pressed.

A respective compartment 52, 54, 56, 58, 60 is provided along the first side in a position corresponding to each timer head location. The compartments may all be the same size and part of a unitary, open-top tray extension 62 along the first side of the frame. Screws (not shown) may engage slots 64 to mount the assembly to a wall, for example. Partitions 65 may be removable by sliding up, as indicated.

Powering batteries 67 and a sounding element 69 are contained in the frame 20. The element 69 may be any small speaker or transducer.

First end 30 of the frame contains an opening for the sounding element to emit signals through, as will be seen, and a master power switch, at 68.

When it is desired to set the system for use in the simplest mode as, for example, to remind a user to take an aspirin tablet every six hours, the pointer 48 on timer head 40 is set to "six", the power switch 68 is set to "on", the "reset" switch button 49 is depressed to start the timing cycle, and a bottle of aspirin is set in the indicated compartment 52. At the appropriate time the signal will sound and the user will take the medicine, first stopping the sound by pressing the reset button 49 which causes it to reset automatically and the signalling to stop. The pointer may alternatively be a conventional solid state actuating liquid crystal displaying press-to-set, as conventional employed on elevators.

Figure 4:
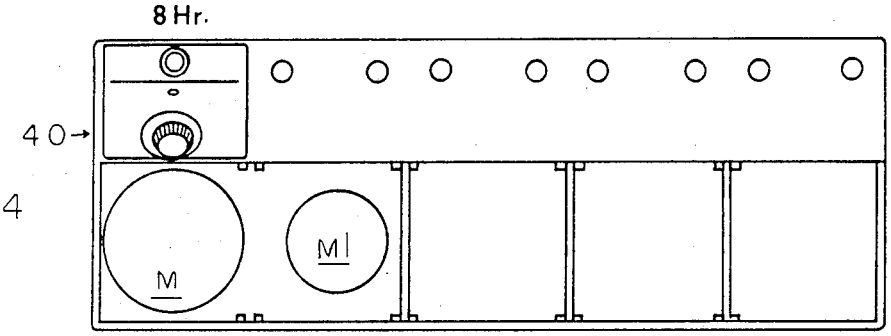
FIG. 4 is a plan view with indication of medicine containers.
Figure 5:
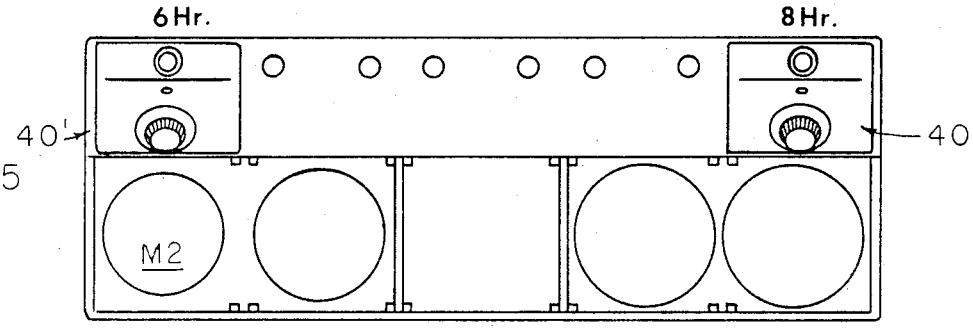
FIG. 5 is a view like that of FIG. 4 with additional timer head.
Figure 6:
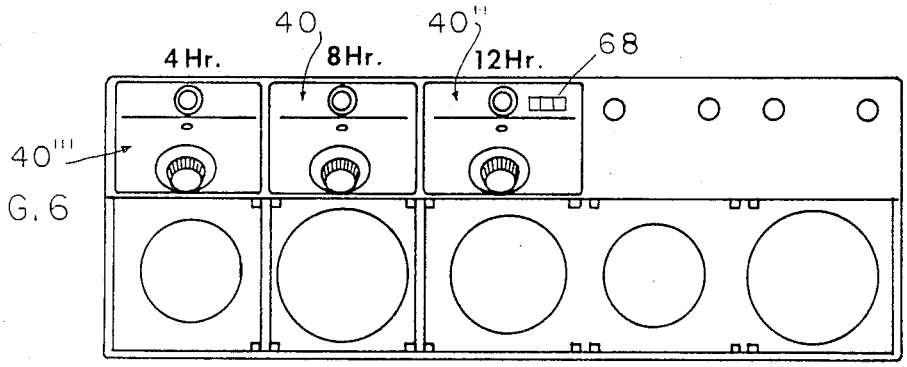
FIG. 6 is a similar view showing a further timer head in a different arrangement.

FIGS. 4–6 show how medicines (in container M, $M_1$ and $M_2$) may be arranged for signalling to be taken by one or more timer heads 40 detachably plugged-in opposite them. As indicated, more complex dosage schedule can be signalled by the system by using more than one timer head, each set to a different timing cycle, as at the notation 8 hr., 6 hr., 12 hr. notations adjacent timer heads 40,40', 40'', and 40''' at 4 hrs.

For example, in the case noted, the same or a different medicine could be signalled at an interval of every few hours, and coincident signals from the second timer ignored, only the first timer being heeded. It will be appreciated that even more compartments and timer heads can be used than there are locations to receive them, making it possible to shift the timing heads from coincidence with one medicine or one timing interval to another, as desired.

Extra timer heads can be removed when not in use, making sure that they do not give false indications or run the battery down.

A safety low voltage such as six volts can be used to power the system.

The timer heads and battery supply can all be connected in parallel. Each timer head can have a separate power switch of its own, as at 68', FIG. 6, if desired.

Any suitable circuit can be used for the preferred embodiment, no claim to the circuit particulars is made, and the intention is to provide for any of several well known and reliable systems, the simpler the better, to be used.

Figure 7:
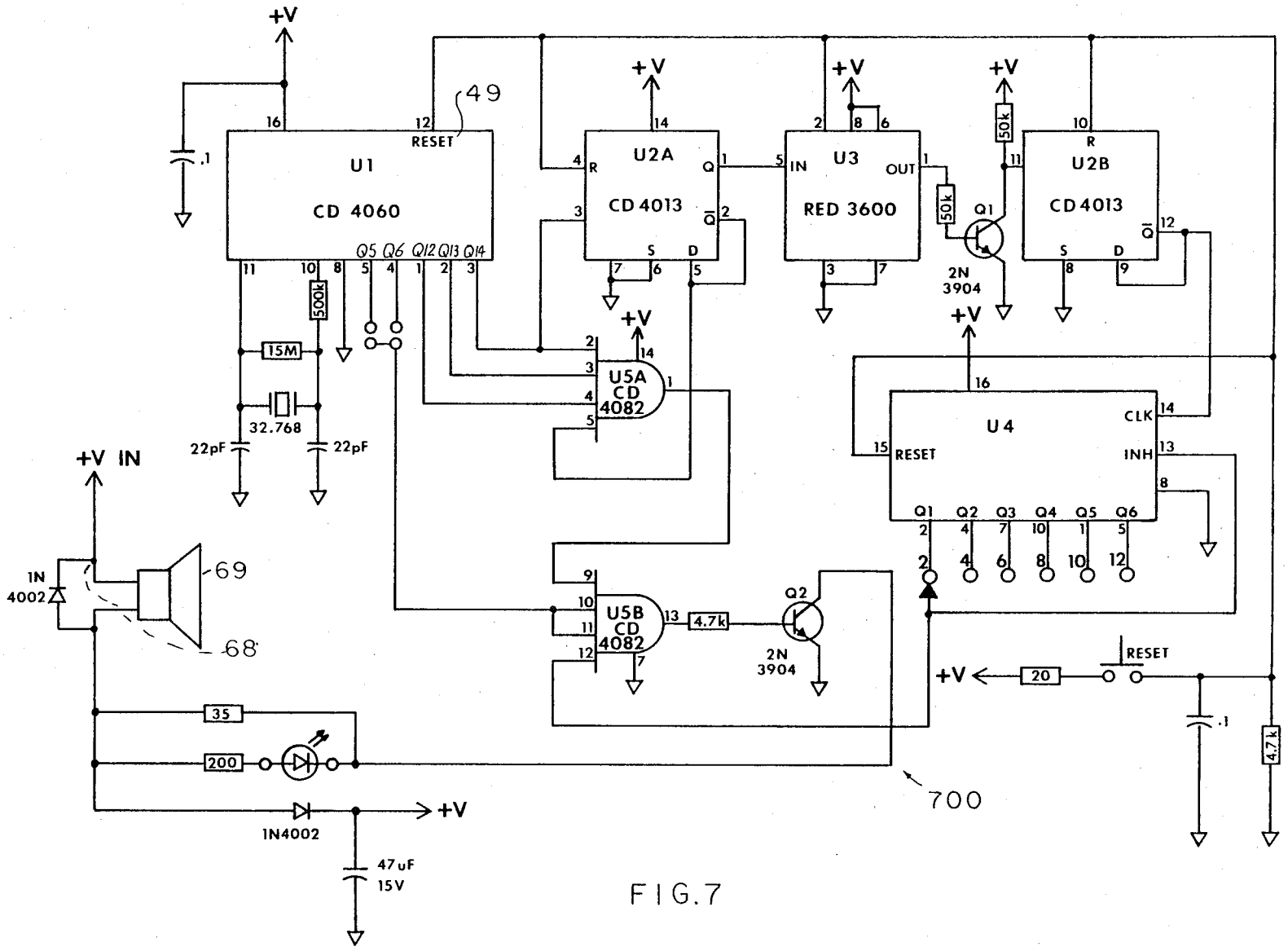
FIG. 7 shows one circuit that can be used with the invention.

A representative conventional circuit may be as follows:

FIG. 7 shows such a circuit. Power is supplied to the circuitry through the alarm speaker and the diode, and filtered by means of the 470 uF capacitor. Very little current is drawn by the CMOS circuitry, so thte alarm speaker is not driven, U1 is a CMOS oscillator circuit which runs at 32 m 768 KHz, as determined by the crystal. When the reset pulse is applied, all divider outputs of U1 are set to zero, and all other IC's are initialized. When the reset line is released, the oscillator begins to count. Pins 5 and 4 of U1 are divider outputs O5 and O6, respectively, and are used to provide an alarm tone frequency of 1024 Hz or 512 Hz, as desired. When the O14 output goes high, which it does twice a second, the output of U2A is toggled, producing an effective frequency of exactly 1 pulse per second. U3 is a divide-by-3600 1C which produces one output pulse every hour. This pulse is inverted by transistor O1 so that the output of U2B will go high after two hours, and repeat the cycle every two hours thereafter. In this manner, the output of decade counter U4 is incremented every two hours. This process continues until the selected time incremented every two hours. This process continues until the selected time output is reached, which drives the inhibit input high and disables further counting, until reset. This signal also enables the four-input AND gate U5B. Its output consists of a series of tone bursts with a frequency as selected from O5 or O6 of U1, with an on time of ⅛ second, at repetition rate of once a second, as determined by the O12-O14 outputs of U1 and the output of U2A. This signal drives the base of transistor O2, which conducts current through the resistor /LED circuit and the speaker. The circuit continues to be powered through the diode and capacitor, which is charged up during the off cycle.

In summary, the versatility of the quick connect/disconnect feature at 42, 44, FIG. 2, in conjunction with the matching sockets 36, 38, FIG. 1, can be used in place of individual switches for the timer heads and are means also for designating which locations and which times selected medicines and/or amounts of medicines can be indicated graphically for dosage, all timer heads preferably being identically oriented.

The assembly is not only versatile and compact, but also can be redundant so that if one timer head is misplaced, another can be substituted for it.

Medicine can be displayed clearly and yet be in original containers, if desired. All timer heads can be identical, for economy, and for certainty in use so that all positions can be interchangeably used. For convenience and to prevent confusion, all timer heads lie adjacent in a straight row along the top of the assembly frame, as do the stations or paired connectors in the top of the frame.

Cleaning is easy, the timer heads and the frame being indicidually cleanable.

The batteries may be conventionally mounted as in a flashlight, through an access door 70 in the frame or housing 20, and held by brackets 71,73 as indicated.

This invention is not to be construed as limited to the particular forms disclosed herein, since these are to be regarded as illustrative rather than restrictive. It is, therefore, to be understood that the invention may be practiced within the scope of the claims otherwise than as specifically described.

For example, the system is well suited for institutional use (as in nursing homes and hospitals) and need not be used with medicine in the containers. Instead, an empty container with identification of the medicine could be used in a hospital or nursing home. When the patient heard the alarm sound or saw the light flashing, he or she could see what medicine had to be taken at that time and call the nurse to administer the medicine.

Alternatively, at the nurse's station, the entire system could be used. The nurse could operate the system and when the alarm sounded, take the indicated medicine to a particular patient.

It will be appreciated that the inventor did not design the constructional details of the electrical system and makes no claim to such, instead he designed and specified co-active functional aspects of the invention with which the circuitry can be used. Circuitry can be made to do the same thing, but be conventionally constructed otherwise than as described.

What is claimed and desired to be protected by United States letters patent is:

1. A system for signalling times to take medicine according to a schedule that may include irregular intervals, the system including: timing means, respective means for containing medicine in a plurality of locations, and means for designating by said timing means particular locations of said plurality of locations, the improvement comprising in combination: a frame, a plurality of electrical connections spaced along said frame and comprising a series of stations corresponding to said locations, said timing means having means for quick/attachment quick detachment to and from said electrical connections respectively along said series of stations, said respective means for containing medicine locations corresponding to said series of stations, whereby the timing means can be located at any of said stations and designate particular medicines, and means responsive to the timing means for signalling when medicine is to be taken.

2. In a system as recited in claim 1, the timing means comprising a plurality of timer heads, and each timer head being identical with the other.

3. In a system as recited in claim 2, each timer head having indicia providing for setting various time intervals for said signalling.

4. In a system as recited in claim 3, each timer head having as part of said signalling means, a light thereon.

5. In a system as recited in claim 2, all said timer heads being identically oriented in the frame.

6. In a system as recited in claim 1, means for powering said system, said means for powering being in said frame.

7. In a system as recited in claim 1, said stations being aligned in a straight row along the top of the frame.

8. In a system as recited in claim 1, said corresponding of the locations to the stations being laterally corresponding.

* * * * *